United States Patent [19]

Ryan

[11] 4,033,313

[45] July 5, 1977

[54] TOY ELASTIC BAND PROJECTILE-FIRING GUN

[76] Inventor: James Ryan, 105-24 64th Road, Forest Hills, N.Y. 11375

[22] Filed: Jan. 19, 1976

[21] Appl. No.: 650,155

[52] U.S. Cl. ..... 124/17; 124/35 A

[51] Int. Cl.[2] ..... F41B 7/08

[58] Field of Search ..... 124/17, 21, 16, 41 R, 124/35 R, 18

[56] References Cited

UNITED STATES PATENTS

| | | | |
|---|---|---|---|
| 342,563 | 5/1886 | Belisle | 124/17 |
| 1,234,163 | 7/1917 | Henderson | 124/17 |
| 1,883,826 | 10/1932 | Schmidt | 124/17 |
| 1,921,017 | 8/1933 | Weber | 124/17 UX |
| 2,031,359 | 2/1936 | Betty | 124/17 |

*Primary Examiner*—Richard C. Pinkham
*Assistant Examiner*—William R. Browne

[57] ABSTRACT

A toy elastic band projectile-firing gun comprises an elongated barrel and a handle connected to the rear portion of the barrel. A wire trigger element is carried pivotally on the outer face of the handle having one extremity extending forwardly of the handle and the other extremity shaped and dimensioned to slide within a vertical slot in the rear end of the barrel. Depression of the one extremity of the trigger element causes an upward movement of the other extremity of the trigger element within the vertical slot to thereby eject the elastic band from the rear end of the barrel.

5 Claims, 3 Drawing Figures

TOY ELASTIC BAND PROJECTILE-FIRING GUN

BACKGROUND OF THE INVENTION

The present invention relates to toy elastic band guns and more particularly to such guns as employ the elastic band to develop sufficient force to fire projectiles.

Toy elastic band guns of various types have been known heretofore. Generally such prior devices employ a pivotable trigger element mounted in either the barrel or handle of the gun and provide for cocking of the elastic band on a specially formed portion of the trigger element or at the rear end of the barrel. However such devices are adapted to fire the elastic band as the projectile and, therefore, were not concerned particularly with the angle of inclination of the elastic band in its cocked position and during the initial stages of propulsion.

With the ever increasing cost of elastomeric articles, the cost of providing a continuing supply of reasonably high quality elastic bands has removed this type of toy gun from the category of low cost toys such that these toys must now compete with toy guns of more sophisticated design. Further, the increased cost of the elastic bands has made more attractive the use of a toy elastic band gun in which the elastic band remains secured to the gun while a relatively inexpensive projectile is fired. However, elastic band guns known heretofore, providing for inclined cocking of the elastic band, are not suitable for use in the firing of rectangular cardboard projectiles which, during loading, are slid alternately under and over one of the parallel lengths of the elastic band and should be propelled while in a substantially horizontal plane. Further, in an attempt to produce toy guns which simulate authentic firearms such toy devices have become increasingly complex and costly thus negating the original objective of providing inexpensive toy devices.

SUMMARY OF THE INVENTION

It is one object of this invention to provide a toy elastic band gun capable of firing projectiles other than the elastic band and which maintains the initial course or propulsion in a substantially horizontal plane.

It is another object of the invention to provide an inexpensive toy elastic band gun of such construction that a projectile other than the elastic band can be efficiently and relatively accurately fired.

Other objects and advantages of the invention will become readily apparent from the following description.

According to the present invention there is provided a toy elastic band projectile-firing gun comprising; an elongated barrel having a substantially flat upper surface and a vertical slot in the rear end thereof; a handle connected to the barrel adjacent the rear end thereof; an elastic band connected to the front end of the barrel stretchable such that the rear end thereof may be retained by the rear end of the barrel; a wire trigger element mounted pivotally on an exterior side face of the handle such that one extremity of the trigger element extends forwardly of the handle, the other extremity of the trigger element being bent forwardly and dimensioned to slide within the vertical slot between a first lower position below a level at which the elastic band is retained exteriorly on the rear end of the barrel and a second upper position at which the other extremity of the trigger element engages the elastic band and forces same off the rear end of the barrel; and means on the front end of the barrel for retaining the elastic band.

BRIEF DESCRIPTION OF THE INVENTION

In order that the invention may be more fully understood it will now be described, by way of example, with reference to the accompanying drawings in which.

DETAILED DESCRIPTION OF THE INVENTION

Figure 1:
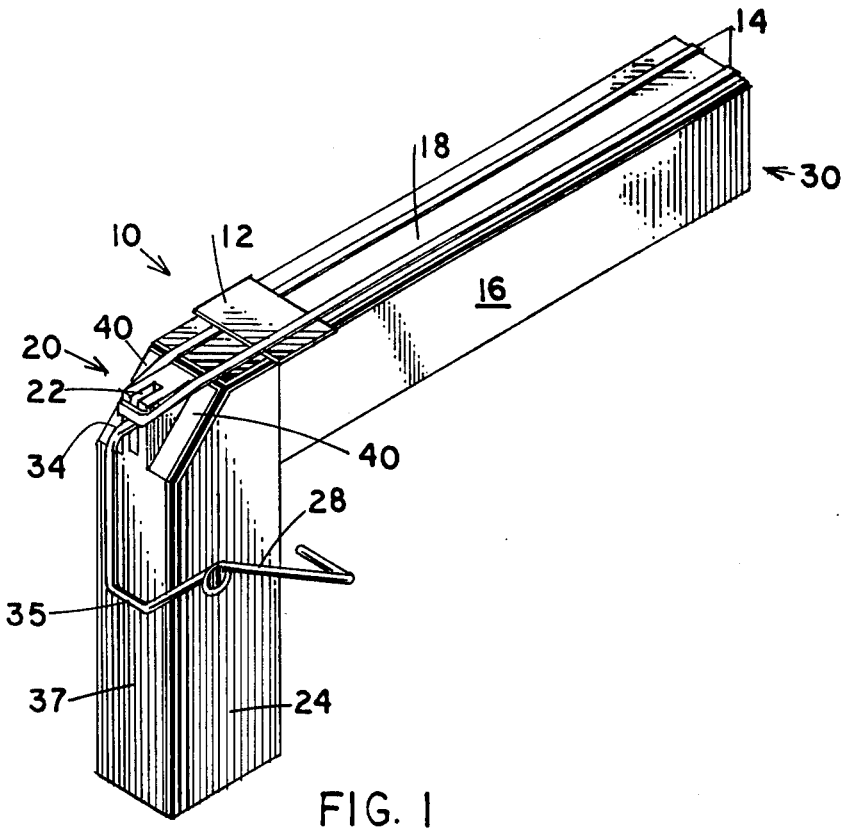
FIG. 1 is a perspective view of a toy elastic band gun embodying the invention.

Referring to the drawings there is shown generally by reference numeral 10 a toy elastic band gun capable of firing projectiles such as the cardboard rectangular projectile 12 which has been loaded in firing position on the gun. It will be observed that the respective parallel lengths of the elastic band 14 are located alternately over and beneath the projectile.

The gun includes an elongated barrel 16 having a substantially flat upper surface 18. The upper surface may be slightly arcuate; however, improved seating of the projectile is achieved with a flat upper barrel surface. The barrel is provided in the rear end 20 thereof with a vertical slot 22 for a purpose to be hereinafter described.

A handle 24 is connected to the barrel adjacent the rear end of the barrel and is provided on an exterior side surface with a stud 26 for the pivotal mounting thereon of a wire trigger element 28.

The wire trigger element 28 is mounted on stud 26, which when the toy gun is marketed in the form of a kit may take the form of a screw, nail or the like, so as to be pivotable thereabout. The wire should be relatively stiff so that it can serve as a lever fulcrumed at stud 26. One simple manner of pivotally mounting the trigger element on the stud element is to provide a loop in an intermediate location wherein the trigger is to be fulcrumed and to mount the loop over the stud. However, other expedients for the pivotal mounting of the trigger element will be readily apparent to persons versed in the art of toy manufacture.

The toy gun includes an elastic band 14 connected to the front end 30 of the barrel and stretchable such that its rear end may be extended over the vertical slot at the rear end of the barrel to be retained thereon.

The wire trigger element is configured so that one extremity 32 extends forwardly of the handle whereas the other extremity is bent forwardly as at 34 and is dimensioned to slide within the vertical slot between a first lower position beneath the level at which the elastic band is retained exteriorly on the rear end of the barrel, in its cocked condition, and a second upper position at which the other extremity of the trigger element engages the elastic band and forces the same off the rear end of the barrel to fire the projectile. A laterally offset portion 35 is provided which extends across the back face 37 of the handle before being deformed to extend upwardly to bent portion 34. The laterally offset portion 35 thus serves as a stop limit for counter clockwise movement of the trigger element and establishes its cocked condition.

Figure 2:
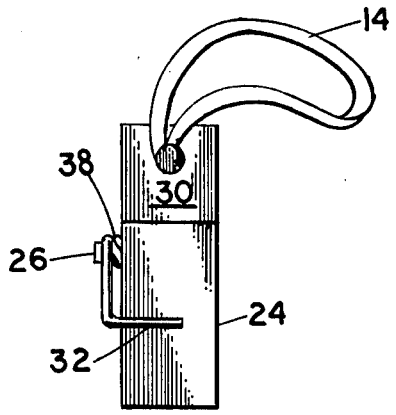
FIG. 2 is a front end view of the toy gun of FIG. 1.
Figure 3:
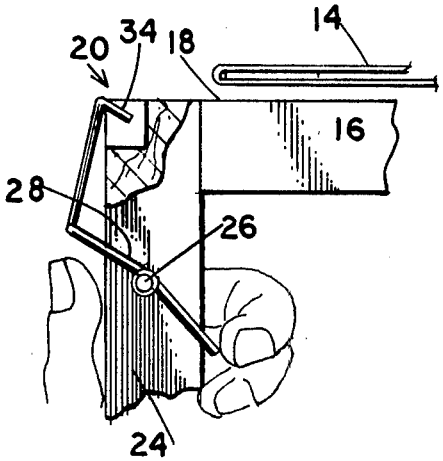
FIG. 3 is a side elevational view, partly in section, and depicting only the rear end portion of the toy.

As may be seen most clearly in FIG. 2, retaining means such as a hook element 36 is provided on the front end of the barrel to securely retain the forward end of the elastic band. Such elastic band retaining means securely fixes the elastic band in position during the cocking step and retains the elastic band after the projectile has been fired.

The upper portion of the handle is desirably chambered at both side as at 40 with a rearwardly and downwardly chamber in order to facilitate retaining of the elastic band at th rear end of the barrel when it is in its cocked condition.

In order to return the trigger element to its cocked condition as shown in FIG. 1 a spring is provided to bias the trigger element in a counterclockwise direction. Desirably spring 38 encircles stud 26 and has one end thereof affixed to the handle and the other end to the trigger element. However, a coil spring or the equivalent may be arranged so as to provide for the biasing of the trigger element so that the bent portion 34 thereof is retained in the lower portion of the vertical slot.

The barrel and handle of the gun may be made of any suitable material such as wood, plastic or even metal. However, the market price of the toy is a significant factor in the selection of the material.

From the foregoing it will be seen that a toy elastic band gun for firing projectiles has been provided which is extremely simple, having only a single movable element other than the elastic band, and which can be manufactured at low cost. Further, because of the unique arrangement of the vertical slot in the rear end of the barrel and the wire trigger element with its bent portion slidable within the vertical slot the toy gun is capable of releasing the elastic band from its cocked position so as to maintain the band and projectile in an initial substantially horizontal plane to assure retention of the projectile in engaged relation with the elastic band until sufficient propulsion force is developed.

What is claimed is:

1. A toy elastic band projectile-firing gun comprising:

an elongated barrel having a substantially flat upper surface and a vertical slot in the rear end thereof;

a handle connected to said barrel adjacent the rear end thereof;

an elsstic band connected to the front end of said barrel and stretchable across the upper surface thereof such that the rear end of said elastic band is retained in its cocked position by the rear end of the barrel with the parallel reaches thereof disposed on the upper surface of said barrel;

a wire trigger element mounted pivotally at an intermediate location thereof on the exterior side faces of said handle such that one segment thereof extends forwardly of the handle and terminates in a first transverse section projecting across the front of the handle, another segment of said trigger element extending rearwardly from said intermediate location and having a second transverse section projecting across the rear of the handle, said second transverse section having integral therewith an unwardly extending section which is bent forwardly at the outer extremity thereof and is dimensioned to be positioned within and to slide within said vertical slot between a first lower position below a level at which the elastic band is retained exteriorly on the rear end of said barrel and a second upper position at which said bent outer extremity of the trigger element engages said elastic band and forces same off the rear end of the barrel, said first and scond transverse sections of said trigger element being engageable with the front and rear portions of said handle to thereby establish the slidable movement limits of said bent outer extremity of the trigger element within said vertical slot.

2. A toy elastic band gun according to claim 1, including hook-like retaining means on the front end of the barrel for securing the forward end of said elastic band thereto and a rearwardly and downwardly chamfered surface on the upper portion of said handle on both sides of said vertical slot to provide a support surface for retaining of the elastic band at the rear end of the barrel.

3. A toy elastic band gun according to claim 1, including spring means secured to said trigger element to bias same so that said other extremity thereof is positioned in the lower portion of said vertical slot.

4. A toy elastic band gun according to claim 3, wherein said spring means comprises a spiral spring fixedly connected at one end to said trigger element and at the other end to said handle.

5. A toy elastic band gun according to claim 1, including stud means carried by said handle for pivotally mounting said trigger element.

* * * * *